US009021981B2

(12) United States Patent
Raiti de Boyles

(10) Patent No.: US 9,021,981 B2
(45) Date of Patent: May 5, 2015

(54) PILL REMINDER WHEEL

(71) Applicant: Daniela Raiti de Boyles, Ojai, CA (US)

(72) Inventor: Daniela Raiti de Boyles, Ojai, CA (US)

( * ) Notice: Subject to any disclaimer, the term of this patent is extended or adjusted under 35 U.S.C. 154(b) by 9 days.

(21) Appl. No.: 14/029,930

(22) Filed: Sep. 18, 2013

(65) Prior Publication Data

US 2015/0078139 A1 Mar. 19, 2015

(51) Int. Cl.

| | |
|---|---|
| ***B65D 83/04*** | (2006.01) |
| ***G09F 9/00*** | (2006.01) |
| ***A61J 7/04*** | (2006.01) |

(52) U.S. Cl.

CPC ..... *A61J 7/04* (2013.01)

(58) Field of Classification Search

USPC ..... 368/10, 223; 116/308, 311, 315; 206/230, 459.1, 534

See application file for complete search history.

(56) References Cited

U.S. PATENT DOCUMENTS

| | | | | |
|---|---|---|---|---|
| 332,208 | A | 12/1885 | Noel | |
| 2,066,183 | A | 12/1936 | Mehaffey | |
| 2,450,949 | A | 10/1948 | Cermtl | |
| 2,565,095 | A | 8/1951 | Schatzkin | |
| 2,587,147 | A | 2/1952 | Evelyn | |
| 3,151,599 | A | 10/1964 | Livingston | |
| 3,921,568 | A | 11/1975 | Fish | |
| 4,011,829 | A | 3/1977 | Wachsmann | |
| 4,041,628 | A | 8/1977 | Sasson | |
| 4,345,541 | A | 8/1982 | Villa-Real | |
| 4,347,804 | A * | 9/1982 | Villa-Real | 116/308 |
| 4,365,722 | A | 12/1982 | Kramer | |
| 4,405,045 | A | 9/1983 | Villa-Real | |
| 4,432,300 | A | 2/1984 | Lyss | |
| 4,489,834 | A | 12/1984 | Thackrey | |
| 4,501,370 | A | 2/1985 | Kelley | |
| 4,528,933 | A | 7/1985 | Allen | |
| 4,641,759 | A | 2/1987 | Kelley | |
| 4,662,520 | A | 5/1987 | Griffin | |
| 4,729,472 | A | 3/1988 | Lubin | |
| 4,753,189 | A | 6/1988 | Mastman | |
| 4,756,423 | A | 7/1988 | Holtsch | |
| 4,802,438 | A | 2/1989 | DeJonge | |
| 4,913,083 | A | 4/1990 | Valvo | |
| 4,915,256 | A * | 4/1990 | Tump | 221/5 |
| 4,920,912 | A | 5/1990 | Kirkling | |
| 5,009,338 | A | 4/1991 | Barker | |

(Continued)

OTHER PUBLICATIONS

Meera Viswanathan, Interventions to Improve Adherence to Self-administered Medications for Chronic Diseases in the United States, Annals of Internal Medicine, 2012, USA.

(Continued)

*Primary Examiner* — Vit M Miska

(57) ABSTRACT

A device to be mounted or adhere to a bottle cap, a box or other surface that easy and economically tracks when the last day and dose of a medicine or vitamin was taken or when the next is due The present invention comprises two disk and a dial. The base disk has indicia representing the days of the week, recessed teeth on the edge means to inhibit counter-clockwise rotation of the cover disk and a central pin protruding from the center that clasp the three elements together at the same times that allows rotation of the cover disk over the base. The cover disk has indicia for the dose with a protruding wedge tooth means to inhibit counterclockwise rotation of the cover in relation to the base and a window to see the indicia of the base disk. The dial points to the dose indicia and holds the three parts together once the pin from the base disk clasp inside its aperture.

15 Claims, 3 Drawing Sheets

(56) References Cited

U.S. PATENT DOCUMENTS

| | | | | |
|---|---|---|---|---|
| 5,216,975 | A | 6/1993 | Bartholomew | |
| 5,261,548 | A | 11/1993 | Barker et al. | |
| 5,271,353 | A | 12/1993 | Besthorne | |
| 5,279,422 | A | 1/1994 | Adams | |
| 5,299,701 | A | 4/1994 | Barker | |
| 5,377,614 | A | 1/1995 | Glazer | |
| 5,433,324 | A | 7/1995 | Leonard | |
| 5,577,335 | A * | 11/1996 | Tucker | 40/311 |
| 5,586,087 | A | 12/1996 | Silverson | |
| 5,638,970 | A | 6/1997 | Garby | |
| 5,694,882 | A | 12/1997 | Marshall | |
| 5,720,392 | A | 2/1998 | Price | |
| 5,778,818 | A | 7/1998 | Marshall | |
| D397,295 | S | 8/1998 | Shelton-Ferrell | |
| 5,823,346 | A | 10/1998 | Weiner | |
| 5,896,990 | A | 4/1999 | Barzana | |
| 6,152,067 | A | 11/2000 | Mathison | |
| 6,158,155 | A | 12/2000 | Boney | |
| D481,946 | S | 11/2003 | Nicholson | |
| 6,789,497 | B1 | 9/2004 | Aiken | |
| 6,912,968 | B2 | 7/2005 | Carbajal | |
| 7,017,762 | B2 | 3/2006 | Shane | |
| 7,555,995 | B1 * | 7/2009 | Stump et al. | 116/311 |
| 7,621,231 | B2 | 11/2009 | McNeely | |
| 7,637,227 | B2 | 12/2009 | Stradella | |
| 7,779,775 | B2 | 8/2010 | Campbell | |
| 7,878,350 | B2 | 2/2011 | Ramoundos | |
| 7,886,909 | B2 | 2/2011 | Robinson | |
| 7,913,437 | B2 | 3/2011 | Domenig | |
| 7,959,023 | B2 | 6/2011 | Ferrara | |
| 8,105,291 | B2 | 1/2012 | Silvester | |
| 8,146,528 | B2 | 4/2012 | Fralick | |
| 8,281,733 | B2 | 10/2012 | Kreshek | |
| 8,763,553 | B1 * | 7/2014 | Shannehan et al. | 116/308 |
| 2003/0000452 | A1 | 1/2003 | Zamjahn | |
| 2004/0144677 | A1 | 7/2004 | Miller | |

OTHER PUBLICATIONS

Eduardo Sabaté, . Adherence to long-term therapies: evidence for action (PDF), 2003, World Health Organisation, Geneva, Switzerland.

Meichenbaun & Turk, Facilitating treatment adherence: A practitioner's guidebook, 1987, Plenum Press, New York, USA.

* cited by examiner

PILL REMINDER WHEEL

1. FIELD OF THE INVENTION

The present invention relates to reminder devices and, more particularly, the present invention pertains to a reminder device designed to assist users in recording their medication, pills, capsules, caplets, dietary supplements, homeopathic medicines and vitamin doses by placing it on bottles tops, boxes or other surfaces. The present invention assists individuals in remembering whether or not they have taken their medication. The Pill Reminder Wheel provides individuals with a recording device to register the day and dose for each medication or vitamin while allowing users to attach the Pill Reminder Wheel to a lid, a top, a box or other surface.

2. DESCRIPTION OF THE PRIOR ART

Without an efficient method for recording medication information, individuals, caregivers and medical personal may have difficulty remembering if and when pills, medicine or vitamins where provided. Many medication must be taken daily, some at multiple intervals. Others are taken only as needed, but the patient or caregiver must know when the last dose was taken to prevent overdosing. If an individual loses track they may end up missing a dose or taking double their dose, which can both be dangerous to an individual's health. Incorrect consumption is commonly called non-compliance. Some of the dangers associated with non-compliance include ineffectiveness of the medicine, extending illness, hospitalization, or dead. A 2003 World Health Organization study estimates that only 50% of patients suffering from chronic diseases in developed countries follow treatment recommendations (World Health Organization (2003). Adherence to long-term therapies: evidence for action. Geneva: World Health Organization). This rate is even more pronounce in the elders, or patients with compromise mental faculties. This lack of adherence has dramatic and expensive effects on health: in the United States, it is estimated to cause approximately 125.000 deaths a year, at least 10% of hospitalizations (close to 3.5 million), and a substantial increase in morbidity and mortality. Non-adherence has been estimated to cost the U.S. health care system between $100 billion and $289 billion annually (Ann Intern Med. 2012; 157(11):785-795. doi: 10.7326/0003-4819-157-11-201212040-00538). Non-compliance is the greatest single cause for readmissions to hospitals (Meichenbaun & Turk, 1987). Non-compliance is largely because of the lack of adaptable, simple, systematic, easy to use and economically available recording devices. Several medicine dose-tracking devices are currently available to consumers or have been described in prior art. Some are containers with multiple compartments for different doses per day of the week. Others are containers with a special cap. Others are foil-lined packet, or blister packs. Earlier attempts have been made in US as in U.S. Pat. No. 5,433,324 A where the indicia is very small and hard to understand, especially for the elders, and does not adapt to every bottle in the market or a box. U.S. Pat. No. 5,896,990 A is for measuring liquids and not to track day or dose. U.S. Pat. No. 2,565,095 A, U.S. Pat. No. 4,347,804 A, U.S. Pat. No. 2,587,147 A, U.S. Pat. No. 3,921,568 A, U.S. Pat. No. 4,011,829 A, U.S. Pat. No. 4,345,541 A, U.S. Pat. No. 4,501,370 A, U.S. Pat. No. 4,920,912 A, U.S. Pat. No. 5,009,338 A, U.S. Pat. No. 5,720,392 A, U.S. Pat. No. 6,152,067 A, U.S. Pat. No. 332,208 A, U.S. Pat. No. 8,281,733 B2, U.S. Pat. No. 5,778,818 and U.S. Pat. No. 5,694,882 A don't allow the record of the day, only the dose or the time. U.S. Pat. No. 4,528,933 A, U.S. Pat. No. 5,823, 346 A U.S. Pat. No. 7,878,350 B2 and U.S. Pat. No. 5,586,087 A are containers with a special closure. U.S. Pat. No. 7,959,023 B2, U.S. Pat. No. 7,913,437 B2, U.S. Pat. No. 7,779,775 B2, U.S. Pat. No. 7,637,227 B2, U.S. Pat. No. 6,912,968 B2, U.S. Pat. No. 4,041,628 A, U.S. Pat. No. 4,662,520 A, U.S. Pat. No. 4,729,472 A and U.S. Pat. No. 6,158,155 A are recording devices not designed for pills, medicines or vitamins. U.S. Pat. No. 5,577,335 A is for doses or days, not both and require difficult assemble to be done by the user. U.S. Pat. No. 4,756,423 A and U.S. Pat. No. 5,377,614 A have very small indicia making it practically impossible to read. U.S. Pat. No. 5,271,353 A does not shows the day, does not attaches securely to the bottle and would be difficult to adapt to a small container. U.S. Pat. No. 7,886,909 B2, U.S. Pat. No. 3,151,599 A and U.S. Pat. No. 4,802,438 A do not show the dose and would be difficult to apply to different sizes of bottles. U.S. Pat. No. 4,432,300 A and U.S. Pat. No. 4,915,256 A are a dispenser, U.S. Pat. No. 8,105,291 B2 does not shows either day and dose. U.S. Pat. No. 4,641,759 A, U.S. Pat. No. 5,261,548 A, U.S. Pat. No. 5,299,701 A, U.S. Pat. No. 5,638,970 A, U.S. Pat. No. 5,279,422 A, U.S. Pat. No. 20040144677 A1, U.S. Pat. No. 8,146,528 B2, U.S. Pat. No. 4,365,722 A, U.S. Pat. No. 4,489,834 A, U.S. Pat. No. 4,753,189 A, U.S. Pat. No. 5,216,975 A, U.S. Pat. No. 4,913,083 A, U.S. Pat. No. 20030000452 A1, U.S. Pat. No. 2,066,183 A, U.S. Pat. No. 2,450,949 A, U.S. Pat. No. 3,151,599 A, U.S. Pat. No. 4,011,829 A, U.S. Pat. No. 4,405,045, U.S. Pat. No. 6,789,497 B1, U.S. Pat. No. 7,017,762, U.S. Pat. No. D397.295, U.S. Pat. No. 7,621,231, and U.S. Pat. No. D481.946 disclosed a dosage reminder cap, lid or closure to replace the cap of a medicine bottle presenting the challenge of the ample variety of bottles sizes and child proof systems available in the market, making it therefore improbable to apply to any bottle given at the pharmacy and impossible to use with a box. Most of such containers violate the legal requirement that medications must be stored in a properly labeled container, they lack child safety features and may mix doses and or medicines. Those inventions are structurally different and are either complicated, with multiples parts, impractical to carry in a purse or pocket, harder to manipulate, difficult and expensive to mass produce, no able to be manufactured cheaply enough to be included or purchase with every prescription or lacking other essential elements which the present invention effectively solves. Some have a different purpose, as to adjust the amount of the dose or to track expiration date or to provide a tactile help, not a visual one. Some are to be attach to the body of the medicine bottle, covering essential information. None of the earlier inventions mentioned have the versatility to be applied to any bottle size or even boxes or surfaces that the present invention inherently possesses and to record the last day and dose of a taken medicine with only three pieces. The data in most of the mentioned inventions is arrange in a confuse way and the size is small, making it hard to read and understand. The present invention provides a simple and economical solution to the problem since it can be made and sold at a nominal cost in comparison with other devices for a similar or equal purpose of the present invention. The Pill Reminder Wheel can be offer included on the prescription or for a very small addiction to the cost of a medicine or vitamin or supplement helping for a little cost to save very expensive complications, treatments, hospitalization and lives.

3. SUMMARY OF THE INVENTION

The present invention preferably comprises a device designed to assist users in recording their medication, pills, capsules, caplets, vitamin doses or similar and keeping track of the day and dose the last medication was taken. The design is comprised of wheel with three components, one base disk, one top disk and one dial. The base disk preferably has adhesive protected by a backing that once removed will expose the adhesive. This will allow the invention to be attached to the lid of any medicine bottle, a box or a surface of the choice of the consumer. The top wheel has a window cut out to show the first or first two initials of each day of the week. Each initial is mark on the base disk. Each initial will be underlined to avoid confusions. The cover disk also has a central recess to houses the dial and to facilitate it turning. The base disk has a central pin with a slighter bigger conical head flat on the top. The cover disk has a central aperture where the pin of the base disk pass though before the head of the pin clasps on the dial cylindrical aperture, securely attaching all parts. The cover disk has a set of circular apertures for the dial's half-ball. The dial will be for the dosage. The dial can be turned from 1 to 4, where 1 denotes the first dose and 4 is the last dose. If more than 4 doses are required the dial can be turned again to 1, 2, 3, 4, or as needed. One end of the dial preferable has a triangular shape to point to the doses. The top of the triangle may be painted on top in a contrasting color. The dial has a half-ball on the base surface of the arrow to secure it in place when it clasps inside the circular apertures of the cover disk. The cover disk may ratchet around the base disk to avoid being turned counter clock-wising. There may be different sizes available to adapt to different drugs, pills, capsules, caplets or vitamin bottles and boxes sizes but one size will fit most. The exact specifications may vary.

The foregoing and other objects and advantages will appear from the description to follow. In the description references is made to the accompanying drawings, which form a part hereof, and in which is shown by way of illustration specifies embodiments in which the invention may be practiced. These embodiments will be described in sufficient detail to enable those skilled in the art to practice the invention and it is to be understood that other embodiments may be utilized and that structural changes may be made without departing from the scope of the invention. In the accompanying drawings, like reference characters designate the same or similar parts throughout the several views. The following detailed description is, therefore, not to be taken in a limiting sense and the scope of the present invention is defined by the pending claims.

4. BRIEF DESCRIPTION OF THE DRAWINGS

A fuller understanding of the nature and objects of the present invention, The Pill Reminder Wheel, will become apparent upon consideration of the following detailed description, taken in connection with the accompanying drawings, wherein:

FIG. 2 also shows parts of the hidden structures of the interior of the dial.

5. DETAILED DESCRIPTION OF THE PREFERRED EMBODIMENTS

Figure 1:
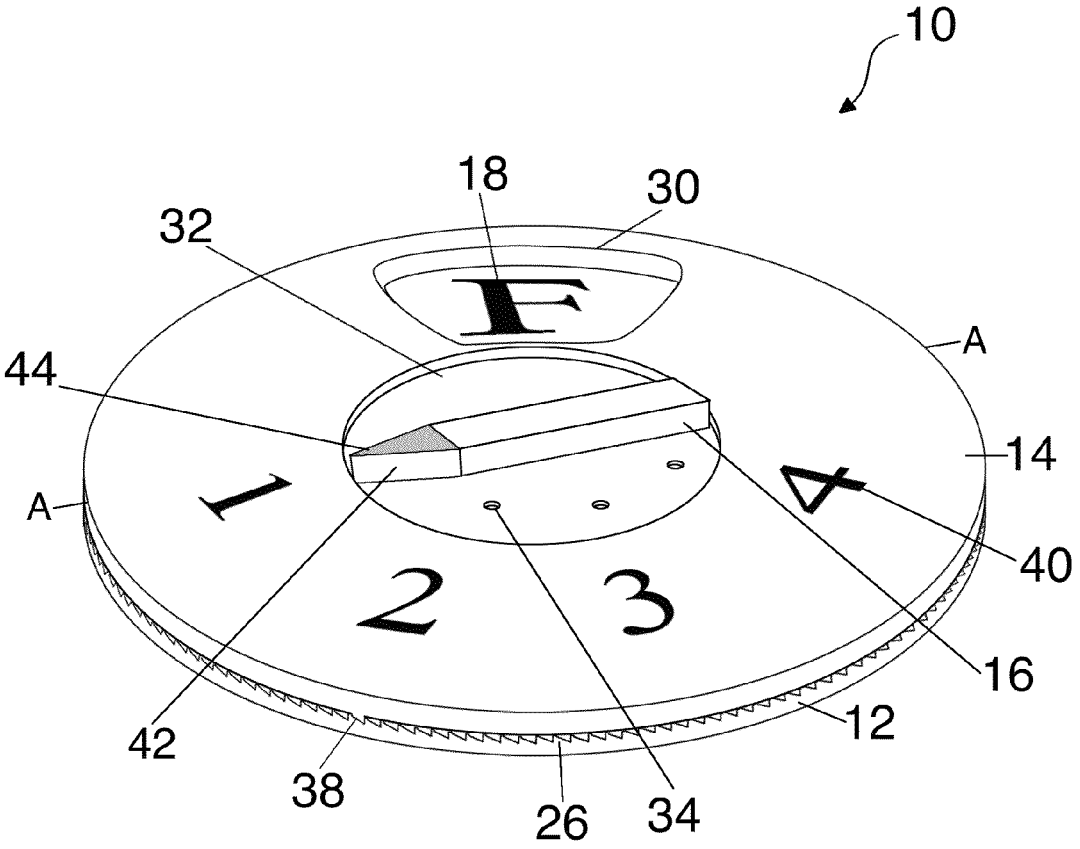
FIG. 1 is a perspective taken from the top view of the present invention, The Pill Reminder Wheel, embodying the invention in a possible position.
Figure 2:
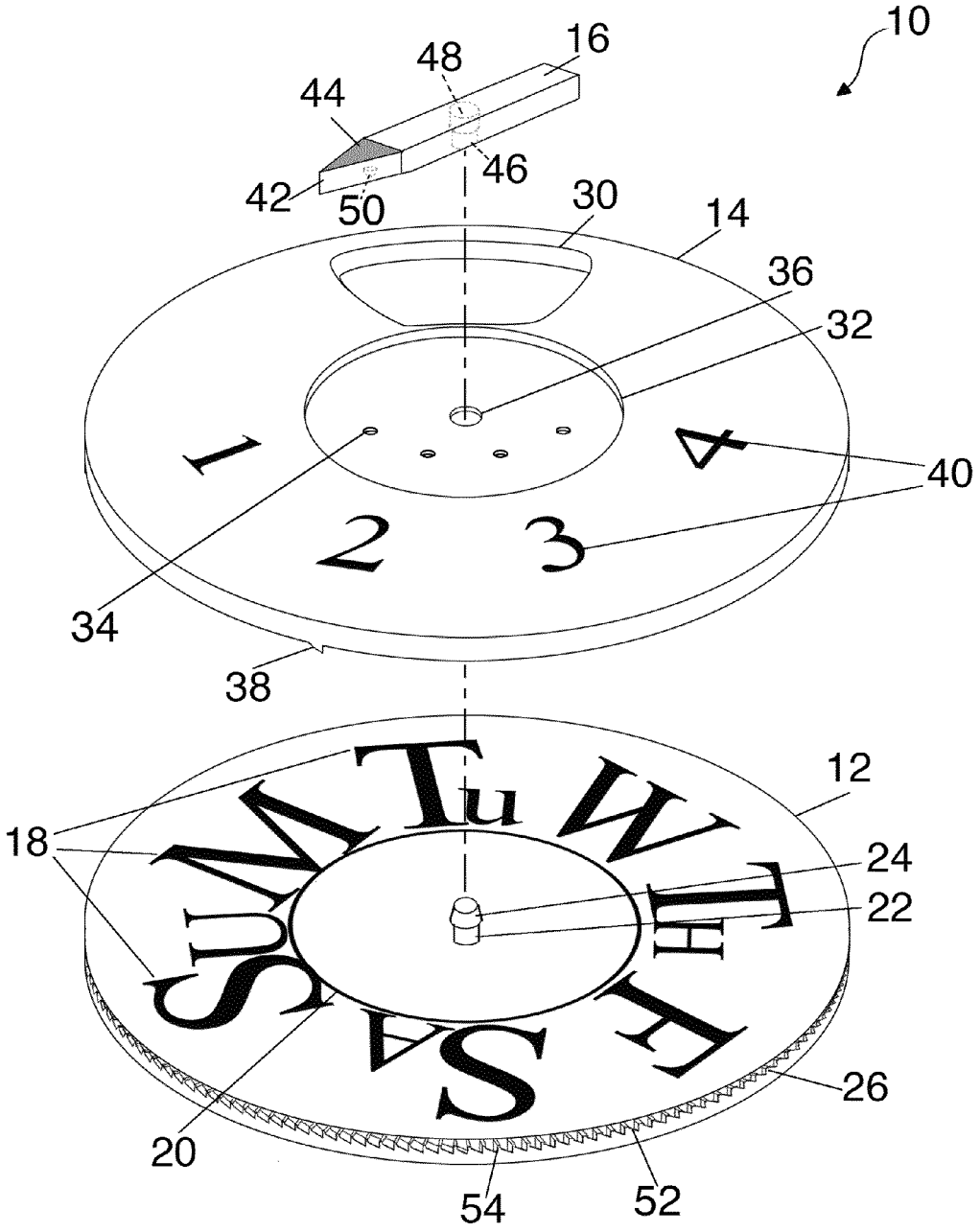
FIG. 2 is an exploded perspective taken from the top view of the pill reminder wheel of FIG. 1.

Referring now to the drawings, in particular to FIGS. 1 and 2, show the Pill Reminder Wheel 10 of the present invention comprising a cover disk 14, indicia for the number of dose 40 dispose equally distribute circumferentially around half the top surface of the cover disk 14 and close to the perimeter of the circular recess 32, a window 30 and a wedge tooth 38 that engages with the set of teeth 26 of the base disk 12 and allows rotation in only one direction. The base disk 12 has indicia for the days of the week 18 viewable through the window 30. The cover disk 14 rotates clockwise and stops when the corresponding day of the week 18 is display though the window 30. One end of the dial 16 ends in a triangular shape 42 and has paint 44 of a contrasting color, preferably red. The dial 16 has a half-ball protuberance 50 on the base of the triangle 42. The half-ball 50 engages in the circular apertures 34 of the cover disk 14 securing the dial 16 pointing towards a dose number 40. The indicia for the days of the week 18 has a line 20 under it. The pin 22 acts as an axis for the cover disk 14 allowing it to rotate around the base disk 12. The pin 22 holds the cover disk 14 and the base disk 12 together when it head 24 clasp in in the head 48 of the cylindrical aperture 46. In FIG. 2. are show hidden structures of the dial 16: the half-ball 50, the cylindrical aperture 48 and it head 46.

Figure 3:
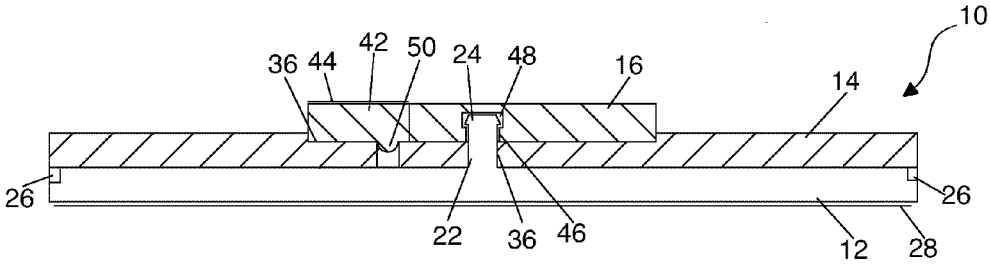
FIG. 3 is a view of the line A-A of FIG. 1.

FIG. 3 shows a view of the line A-A of FIG. 1. The dial 16 is inside the circular recess 32. The head 24 of the pin 22 clasp inside the larger head 48 of the cylindrical aperture 46 of the dial 16 securing the base disk 12, the cover disk 14 and the dial 16 together. The half-ball 50 on the base of the triangular end 42 is inside one of the four circular apertures 34 securing the dial 16 in the desirable position.

Figure 4:
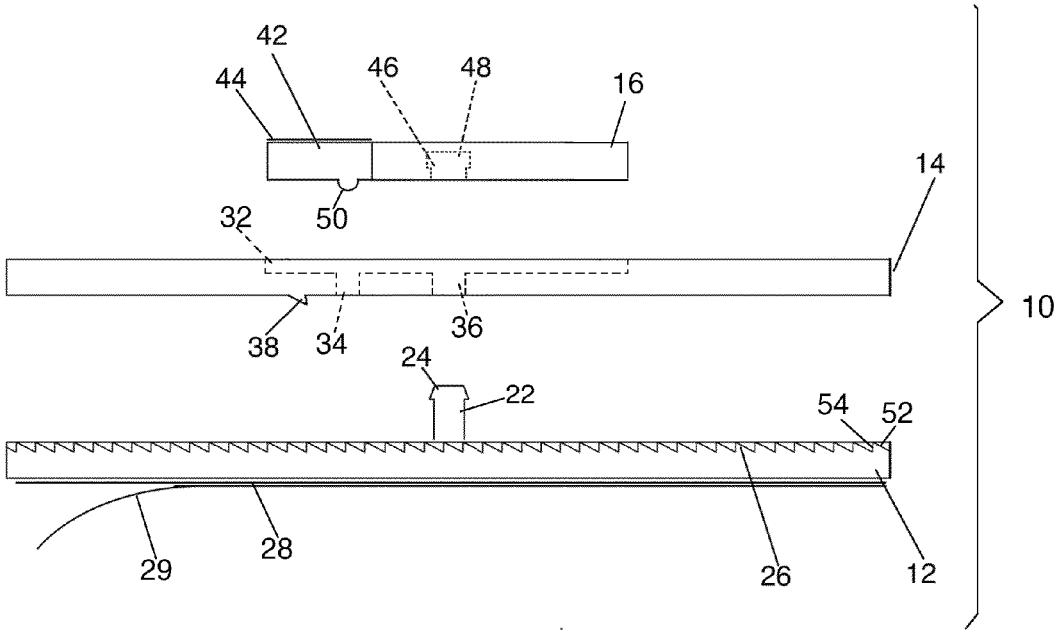
FIG. 4 is a exploded side view of the pill reminder wheel of FIG. 1. Said view also shows parts of the hidden structures of the interior.

FIG. 4 shows a side exploded view of the pill reminder wheel of FIG. 1. The pin 22 is centrally located and in alignment with the central aperture 36 and the cylindrical aperture 46 of the dial 16. The size of the head of the aperture 48 is slightly bigger than the head of the pin 24 means for a secure clasp. The notched triangular shape of the head of the pin 24 means for easy passing though the central aperture 36 of cover disk 14. The head of the dial 42 has paint 44 for easier understanding of the direction pointed. The bottom of the base disk 12 has a self adhesive material 28 protected by a removable layer 29.

The cover disk 14 rotates around the base disk 12 using the pin 22 as an axis. Though the window 30 of the cover disk 14 are visible the different initial/s indicia 18 corresponding to each day of the week marked on the base disk 12. When the edge of the cover disk 14 is held with two fingers and rotated the visible initial/s of the day 18 changes. The dial 14 can be rotated being held with two fingers inside a circular recess 32 of the cover disk 14 pointing with its triangular end 42 to the dose number indicia 40 of the cover dial 14. The half-ball 50 of the dial 16 clasps inside the circular apertures 34 of the cover disk 14 securing the dial 16 in position. The three pieces 12, 14 and 16 are held together by the pin 22 wherein the pin 22 and its head 24 pass though the central aperture 36 of the cover disk 14 and the cylindrical aperture 46 of dial 16, and its head 24 clasps inside the aperture 48 of the dial 16. The wedge tooth 38 passes over the diagonal wall 52 of the teeth 26 and is stop by the horizontal straight wall 54, allowing rotation in only one direction.

Since certain changes may be made in the foregoing disclosure without departing from the scope of the invention, herein involved, it is intended that all matter contained in the above description and depicted in the accompanying drawings be constructed in an illustrative and not in a limiting sense. They are not intended to be exhaustive or to limit the present invention to the precise forms disclosed and obviously many modifications, rearrangements, substitutions of parts and elements and variations are possible in light of the above teaching. The exemplary embodiment was chosen and described in order to best explain the principles of the present invention, The Pill Reminder Wheel, and its practical application, to thereby enable others skilled in the art to best utilize the present invention and various embodiments with various modifications as are suited to the particular use contemplated. The invention as described is susceptible to modification without departing from the concept and right is herein reserved to such modifications as fall within the scope and equivalence of the appended claims.

I claim:

1. An apparatus which indicates when the last day and dose of a medicine, vitamin, supplement or the like was taken, such apparatus comprising:

(a) A base disk having a top and a bottom surface, said top surface comprising indicia indicative of the seven days of the week, said disk having a recess edge disposed circumferentially around the perimeter, said recess having a wall and a base, said base having a set of identical teeth mean for inhibit rotation in one direction, said base having a centrally located pin that projects from said top;

(b) A cover disk having a top and a bottom surface, said disk including an aperture to permit viewing of said indicia; said top marked with indicia indicative of dose, said top having a centrally dispose circular recess, said recess having a centrally disposed aperture, said recess having circular apertures, said bottom surface having a projecting wedge tooth positioned vertically on the edge of said bottom surface, said wedge tooth means for allowing rotation in only one direction wherein engaged with said set of teeth;

(c) A dial having a top and a bottom surface to be mounted within said circular recess of said cover disk, said bottom surface having a projecting protuberance, said bottom surface having a central aperture, wherein said aperture means to clasp said pin of said base disk;

(d) Means for attaching said bottom of said base disk to surface.

2. An apparatus according to claim 1 wherein said cover disk rotates over said base disk pivoting around said pin, said base disk marked with indicia, said indicia indicating the initial of the seven days of the week and said cover disk includes an aperture to permit viewing of said initials.

3. An apparatus according to claim 2, said base disk marked with indicia, said indicia indicating the initial or initials when given place to confusion of the days of the week, said indicia located circumferentially at equally spaced intervals around the edge of said top, said initials underlined.

4. An apparatus according to claim 1, said cover disk surface is marked with indicia, said indicia being numbers from 1 to 4 wherein recording the last dose of a medicine or vitamin taken.

5. An apparatus according to claim 1, said cover disk having four circular apertures inside said central recess.

6. An apparatus according to claim 1, said circular apertures inside said central recess being distributed in proximity to said indicia indicative of number of dose.

7. An apparatus according to claim 1 said dial being of rectangular shape ending in one end in a triangular shape.

8. An apparatus according to claim 5, said triangular shape being marked with a different color or shade of said dial.

9. An apparatus according to claim 5, said dial having on said base surface a protuberant half ball, wherein said half ball clasp inside said circular apertures of said top disk.

10. An apparatus according to claim 1 wherein said base disk has a recess edge disposed circumferentially around the perimeter, said recess having a wall and a base, said base having teeth equally distribute over the base of said recess, said teeth having a diagonal face and a vertical face, means rotation in only one direction when engaged with said projecting wedge tooth of said cover disk.

11. An apparatus according to claim 1, said aperture on said dial being cylindrical and about ¾ the height of said dial from bottom to top, said aperture being bigger at the top, said aperture not passing though said top of said dial.

12. An apparatus according to claim 1, said pin having a head slightly larger than the body of said pin, said head being of conical shape, said cone being flat at the top.

13. An apparatus according to claim 1, wherein said pin of said base disk engage with said cover disk and said dial within the central aperture of said cover disk and within the cylindrical aperture of said dial, where said head of said pin clasping on said bigger top of said cylindrical aperture, means said apparatus is movable fixed together.

14. An apparatus according to claim 1, wherein said base surface of said base disk contains adhesive to secure said apparatus to a bottle top, a box or another surface.

15. A device which indicates when the last day and dose of a medicine/vitamin or when the next one is due, such device comprising:

(a) A bottom wheel, having a top and a bottom surface, said top surface marked with concentric alphabetical indicia indicative of the seven days of the week disposed around the perimeter at equally spaced intervals, said wheel having an inward edge around the perimeter, said edge having a wall and a base, said base having a ratchet gear, said wheel having a projecting centrally located post, said post having a head of conical shape, said head being flat on top;

(b) A top wheel having a top and a bottom surface, said wheel including a window to permit viewing of said alphabetical indicia; said top marked with numeral indicia to indicate number of dose, said top having a centrally disposed circular cavity, said central cavity having circular apertures distributed in the proximity of the circumference of said cavity, said central cavity having a centrally disposed aperture, said aperture wherein passing of said post permitting rotation of said top wheel relative to said bottom wheel, said bottom surface having on the edge a perpendicular projecting detent, said detent means for inhibit rotation in one direction when engaged with said ratchet gear;

(c) A dial having a top and a bottom surface to be positioned within said circular cavity of said top wheel, said bottom surface having a half spherical protruding mass, wherein said spherical mass means to inhibit movement of said dial when engaged with said circular apertures of said top wheel, said bottom surface of said dial having a central cylindrical cavity, wherein said cavity contains said post of said bottom wheel means to lock said bottom wheel in engagement with said top wheel wherein permitting rotation of said top wheel relative to said bottom wheel.

(d) And adhesive means attaching said bottom of said base wheel to surface.

* * * * *